US010585386B2

(12) United States Patent
Maeda

(10) Patent No.: US 10,585,386 B2
(45) **Date of Patent: *Mar. 10, 2020**

(54) IMAGE FORMING APPARATUS CAPABLE OF RESTRICTING OPENING OF COVER

(71) Applicant: KYOCERA Document Solutions Inc., Osaka-shi, Osaka (JP)

(72) Inventor: Hiroyuki Maeda, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 250 days.

This patent is subject to a terminal disclaimer.

(21) Appl. No.: 15/682,265

(22) Filed: Aug. 21, 2017

(65) Prior Publication Data

US 2018/0052419 A1 Feb. 22, 2018

(30) Foreign Application Priority Data

Aug. 22, 2016 (JP) ..... 2016-161998

(51) Int. Cl.
*G03G 21/16* (2006.01)
*G03G 21/18* (2006.01)
(Continued)

(52) U.S. Cl.
CPC ..... *G03G 21/1633* (2013.01); *G03G 15/0865* (2013.01); *G03G 15/556* (2013.01);
(Continued)

(58) Field of Classification Search
CPC ..... G03G 21/1633; G03G 21/1842; G03G 15/0865; G03G 15/556
See application file for complete search history.

(56) References Cited

U.S. PATENT DOCUMENTS 10,012,946 B2 * 7/2018 Maeda ..... G03G 21/1676
2011/0058825 A1 * 3/2011 Tsukijima ..... G03G 21/1633 399/27

(Continued)

FOREIGN PATENT DOCUMENTS

JP 2006231739 A 9/2006
JP 2006301071 A 11/2006

(Continued)

OTHER PUBLICATIONS

Japanese Patent Office, Office Action Issued in Application No. 2016161998, dated Apr. 23, 2019, 6 pages.

*Primary Examiner* — Alessandro V Amari
*Assistant Examiner* — Kendrick X Liu
(74) *Attorney, Agent, or Firm* — Alleman Hall Creasman & Tuttle LLP

(57) ABSTRACT

An image forming apparatus includes an inner cover, an outer cover, a first pressing portion, and a restricting portion. The inner cover is opened and closed for a developer storage portion storing developer to be attached or detached. The outer cover is made of resin and provided on an outer side of the inner cover, and opened and closed in a same direction as the inner cover. The first pressing portion is provided on the outer cover and, when the outer cover is closed in a state where the inner cover is opened, comes into contact with and presses the inner cover in a closing direction. When the inner cover is closed, the restricting portion is engaged with the inner cover at a lock position located on an upstream side of a predetermined closing position of the inner cover in the closing direction, and restricts opening of the inner cover.

9 Claims, 16 Drawing Sheets

(51) Int. Cl.
*G03G 15/08* (2006.01)
*G03G 15/00* (2006.01)

(52) U.S. Cl.
CPC ..... *G03G 15/6502* (2013.01); *G03G 21/1842* (2013.01); *G03G 2221/1684* (2013.01); *G03G 2221/1687* (2013.01)

(56) References Cited

U.S. PATENT DOCUMENTS

| | | | | |
|---|---|---|---|---|
| 2015/0084272 | A1 | 3/2015 | Maruyama et al. | |
| 2016/0033928 | A1* | 2/2016 | Ishimitsu ..... | G03G 21/1633 399/91 |
| 2016/0187839 | A1 | 6/2016 | Ueyama et al. | |

FOREIGN PATENT DOCUMENTS

| | | | |
|---|---|---|---|
| JP | 2008032805 | A | 2/2008 |
| JP | 2009242067 | A | 10/2009 |
| JP | 2010055127 | A | 3/2010 |
| JP | 2011059296 | A | 3/2011 |

* cited by examiner

IMAGE FORMING APPARATUS CAPABLE OF RESTRICTING OPENING OF COVER

INCORPORATION BY REFERENCE

This application is based upon and claims the benefit of priority from the corresponding Japanese Patent Application No. 2016-161998 filed on Aug. 22, 2016, the entire contents of which are incorporated herein by reference.

BACKGROUND

The present disclosure relates to an image forming apparatus for forming an image using developer.

In an electrophotographic image forming apparatus, a developer storage portion is used, wherein the developer storage portion stores developer such as toner and is attached to the image forming apparatus in a detachable manner. The image forming apparatus execute an image forming process of forming an image on a sheet by using the developer supplied from the developer storage portion. This type of image forming apparatus may be provided with a cover that is opened and closed when the developer storage portion is attached or detached.

SUMMARY

An image forming apparatus according to an aspect of the present disclosure includes an inner cover, an outer cover, a first pressing portion, and a restricting portion. The inner cover is opened and closed for a developer storage portion storing developer to be attached or detached. The outer cover is made of resin and provided on an outer side of the inner cover, and is opened and closed in a same direction as the inner cover. The first pressing portion is provided on the outer cover and, when the outer cover is closed in a state where the inner cover is opened, comes into contact with the inner cover and presses the inner cover in a closing direction. When the inner cover is closed, the restricting portion is engaged with the inner cover at a lock position that is located on an upstream side of a predetermined closing position of the inner cover in the closing direction, and restricts opening of the inner cover.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
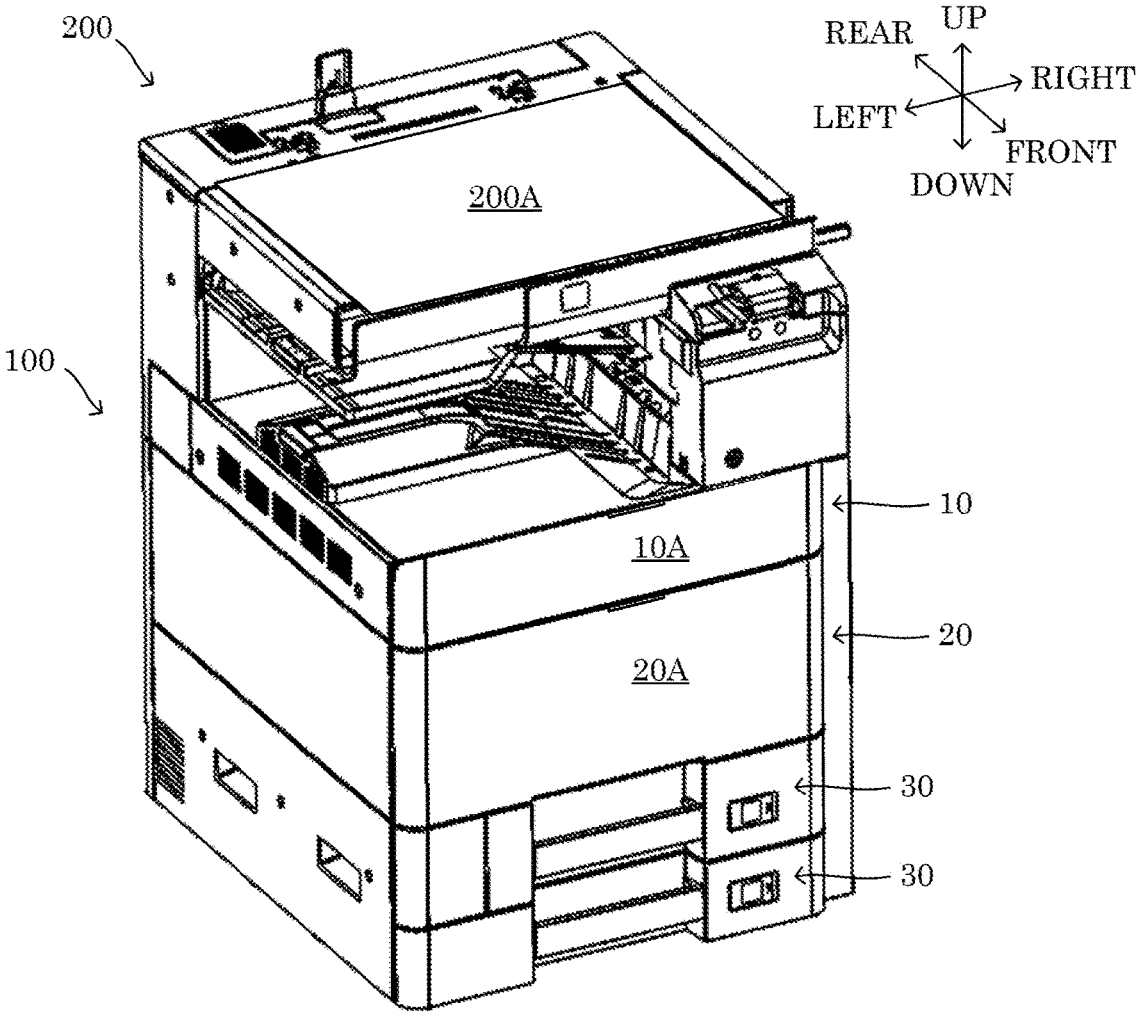
FIG. 1 is a diagram showing a configuration of an image forming apparatus according to a first embodiment.

The following describes embodiments of the present disclosure with reference to the accompanying drawings. It should be noted that the following embodiments are an example of specific embodiments of the present disclosure and should not limit the technical scope of the present disclosure. It is noted that description may be given with reference to the front-rear direction, up-down direction, and left-right direction defined in the drawings.

First Embodiment

As shown in FIG. 1, a multifunction peripheral according to a first embodiment includes an image forming apparatus 100 and an image reading device 200. The image reading device 200 is attached to an upper part of the image forming apparatus 100 and is configured to read image data from a document sheet placed on a document sheet table 200A, by using an imaging element such as a CCD. It is noted that the image forming apparatus 100 according to the present disclosure may be a printer without the image reading device 200 attached thereto.

The image forming apparatus 100 is a color printer including a container storage portion 10, an image forming portion 20, and sheet feed cassettes 30. A plurality of developer storage portions 101 (see FIG. 4) storing developer such as toner of different colors can be individually attached to the container storage portion 10 in a detachable manner.

A front cover 10A (an example of the external cover) made of resin is provided at the front of the container storage portion 10 in an openable and closable manner, and a front cover 20A is provided at the front of the image forming portion 20 in an openable and closable manner. It is noted that the image forming apparatus 100 includes an opening/closing detecting portion 10B (see FIG. 2), such as an optical sensor, that detects opening/closing of the front cover 10A.

A lower part of each of the front cover 10A and the front cover 20A is pivotably supported by a pivot shaft that is parallel to the left-right direction, for example. That is, it is possible to open each of the front cover 10A and the front cover 20A by pivoting its upper part frontward. The sheet feed cassettes 30 are attached to the image forming apparatus 100 in a detachable manner. Sheets such as sheets of paper on which images are to be formed, are stored in the sheet feed cassettes 30.

Figure 2:
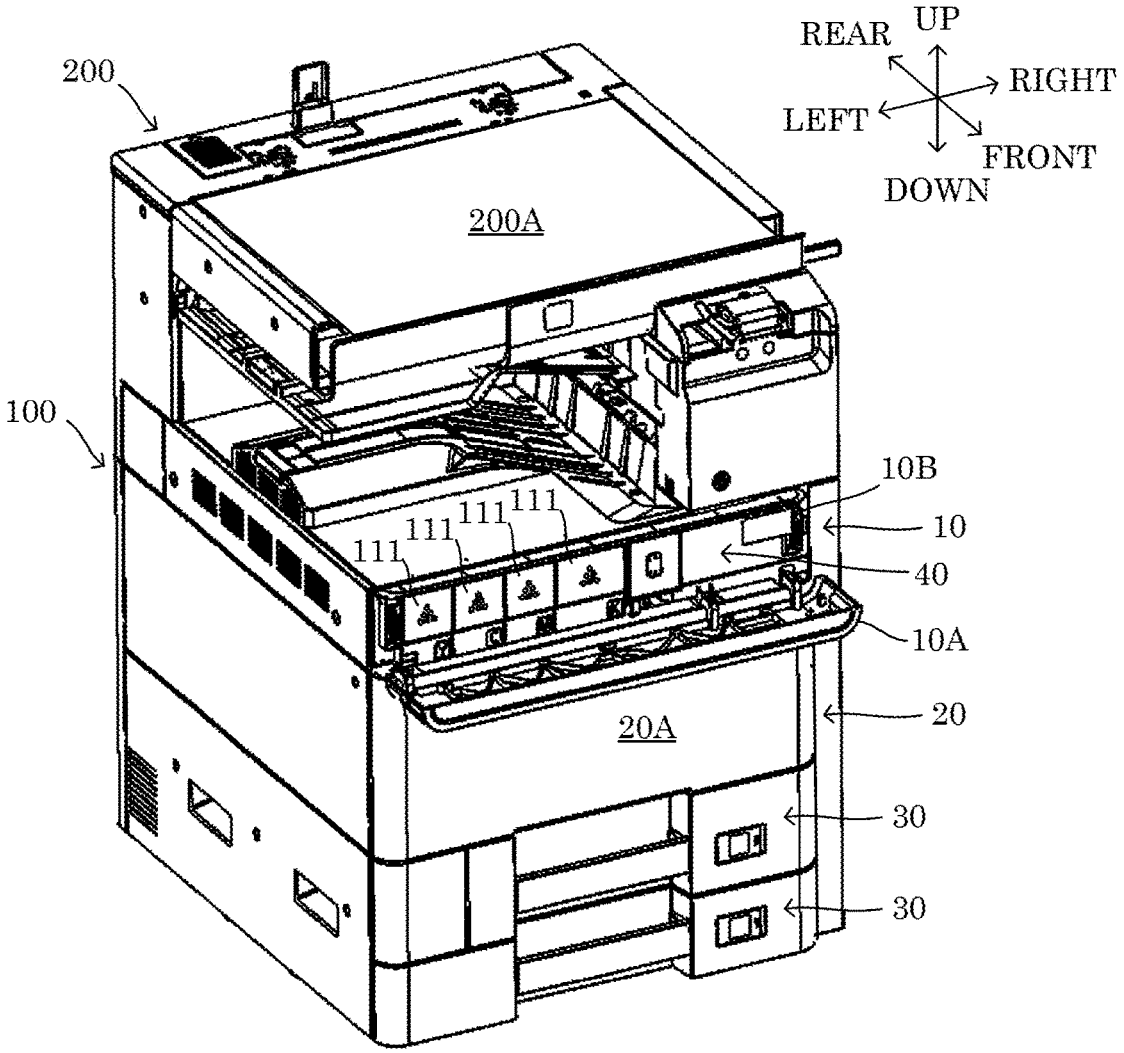
FIG. 2 is a diagram showing a configuration of the image forming apparatus according to the first embodiment.

FIG. 2 shows a state where the front cover 10A is opened. The container storage portion 10 includes a lock unit 40 that is configured to switch between ability and disability for the plurality of developer storage portions 101 storing developer such as toner to be attached or detached.

The lock unit 40 is an option unit that is attached to the container storage portion 10 of the image forming apparatus 100 in a detachable manner. The lock unit 40 includes a plurality of lock devices 11 (see FIG. 5 and FIG. 6) that respectively correspond to the plurality of developer storage portions 101. In the plurality of lock devices 11, a plurality of lock covers 111 (an example of the inner cover) that respectively correspond to the plurality of developer storage portions 101 storing developer of different colors, can be individually opened and closed, wherein each lock cover 111 is opened and closed when a corresponding developer storage portion 101 is attached or detached.

Figure 3:
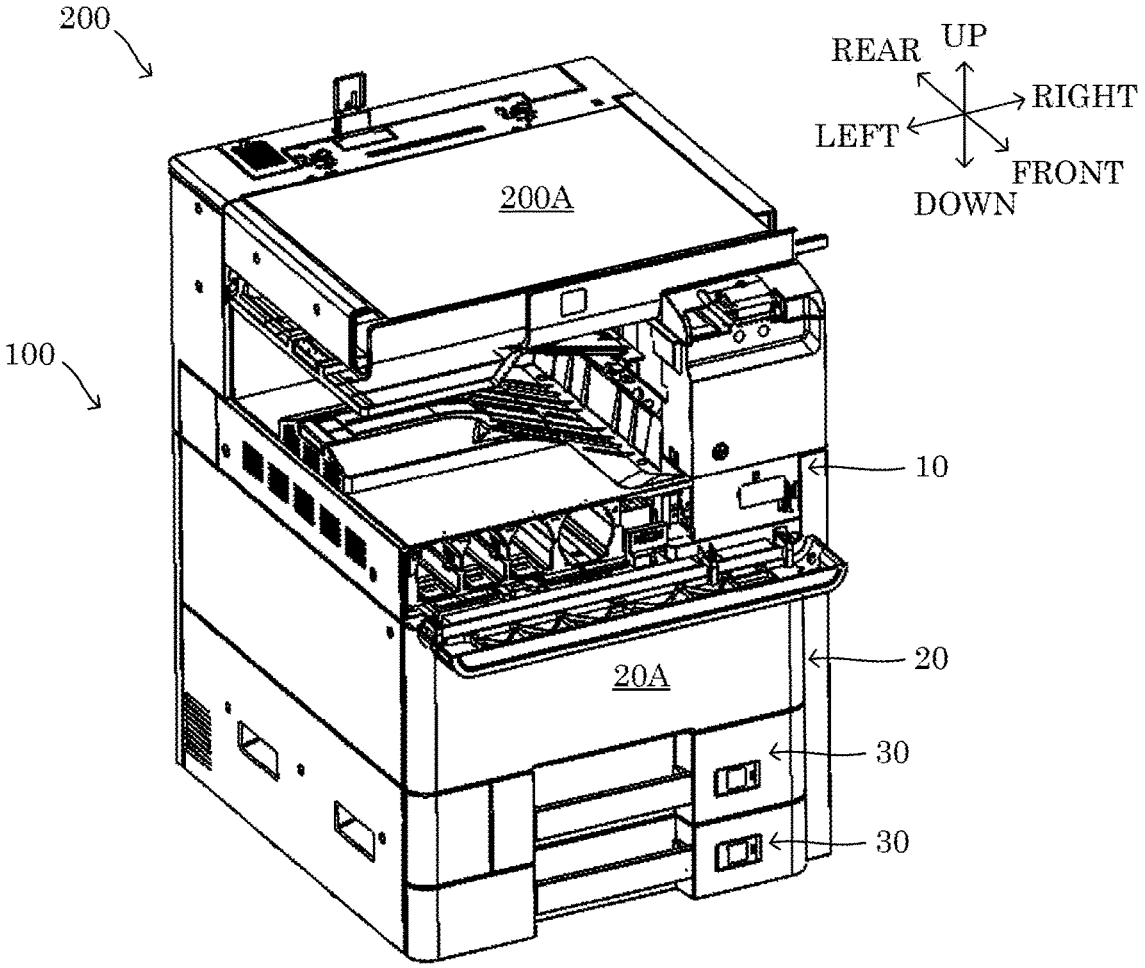
FIG. 3 is a diagram showing a configuration of the image forming apparatus according to the first embodiment.

Each lock device 11 is configured to switch between presence and absence of restriction applied to opening of a lock cover 111 thereof. The lock unit 40 is described in detail below. It is noted that FIG. 3 shows a state where the lock unit 40 is removed from the apparatus. The developer storage portions 101 can be attached to and detached from the image forming apparatus 100 even in a state where the lock unit 40 is not attached thereto, and the image forming apparatus 100 can be used even in the state where the lock unit 40 is not attached.

Figure 4:
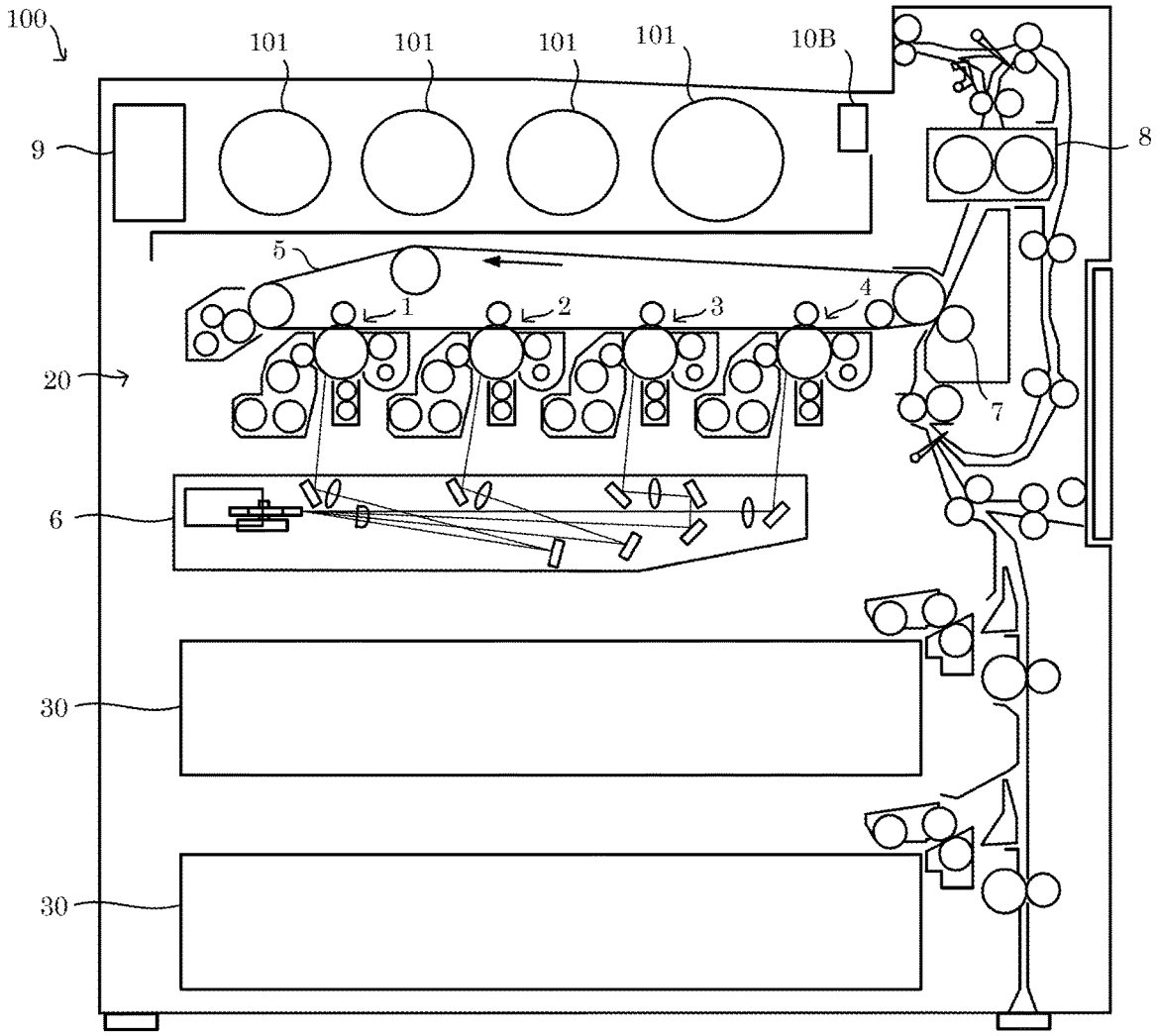
FIG. 4 is a diagram showing a configuration of the image forming apparatus according to the first embodiment.

As shown in FIG. 4, the image forming portion 20 includes a plurality of image forming units 1 to 4, an intermediate transfer belt 5, a laser scanning device 6, a secondary transfer device 7, and a fixing device 8. The image forming portion 20 is configured to form a monochrome or color image on a sheet such as a sheet of paper supplied from any of the sheet feed cassettes 30, by using the developer stored in the developer storage portions 101.

The image forming units 1 to 4 are electrophotographic image forming units each of which includes a photoconductor drum (image carrier), a charging device, a developing device, a primary transfer device, and a drum cleaning device, and form an image by using the developer stored in the developer storage portions 101. The image forming units 1 to 4 are arranged in alignment along the running direction of the intermediate transfer belt 5 and constitute the image forming portion 20 of a so-called tandem type. Developer of colors Y, M, C, and K is supplied from the developer storage portions 101 to the developing devices of the image forming units 1 to 4.

The image forming apparatus 100 further includes a control portion 9 that includes a CPU, a ROM, and a RAM, and controls the image forming apparatus 100 and the image reading device 200. Specifically, the control portion 9 detects a remaining amount or used amount of developer in each of the developer storage portions 101, and when the remaining amount or used amount of developer has reached a predetermined threshold, informs the reduced remaining amount of developer as an error, on a display portion (not shown) or the like. For example, the remaining amount or used amount of developer can be detected based on a detection result of an optical sensor or a weight sensor, or a calculation result obtained based on the number of printed sheets or the printing rate. In addition, the control portion 9 that is detecting the remaining amount or used amount of developer in the developer storage portions 101 is an example of the developer detecting portion.

As described above, the control portion 9 executes a lock control process of arbitrarily switching between ability and disability for lock covers 111 of lock devices 11 to be opened, wherein the lock devices 11 and the lock covers 111 are described below. Specifically, in the lock control process, when the remaining amount of developer is detected in each of the developer storage portions 101, the control portion 9 locks lock covers 111 that correspond to developer storage portions 101 in which the remaining amount of developer is larger than the threshold, and unlocks lock covers 111 that correspond to developer storage portions 101 in which the remaining amount of developer is equal to or smaller than the threshold.

More specifically, in the first embodiment, when the opening/closing detecting portion 10B detects opening of the front cover 10A in a state where the remaining amount of developer in any of the developer storage portions 101 is equal to or smaller than the threshold, the control portion 9 unlocks a lock cover 111 that corresponds to that developer storage portion 101. At this time, among the plurality of lock covers 111, only the lock cover 111 corresponding to the developer storage portion 101 in which the remaining amount of developer is equal to or smaller than the threshold, is unlocked.

With this configuration, when the user opens the front cover 10A, among the plurality of lock covers 111, only a lock cover 111 for a developer storage portion 101 that needs to be replaced is unlocked. Accordingly, the configuration prevents one or more developer storage portions 101 in which the remaining amount of developer is larger than the threshold and that need not to be replaced, from being replaced wastefully. It is noted that the condition for unlocking the lock covers 111 is not limited to this condition.

Next, the lock unit 40 is described with reference to FIG. 5 to FIG. 14.

Figure 5:
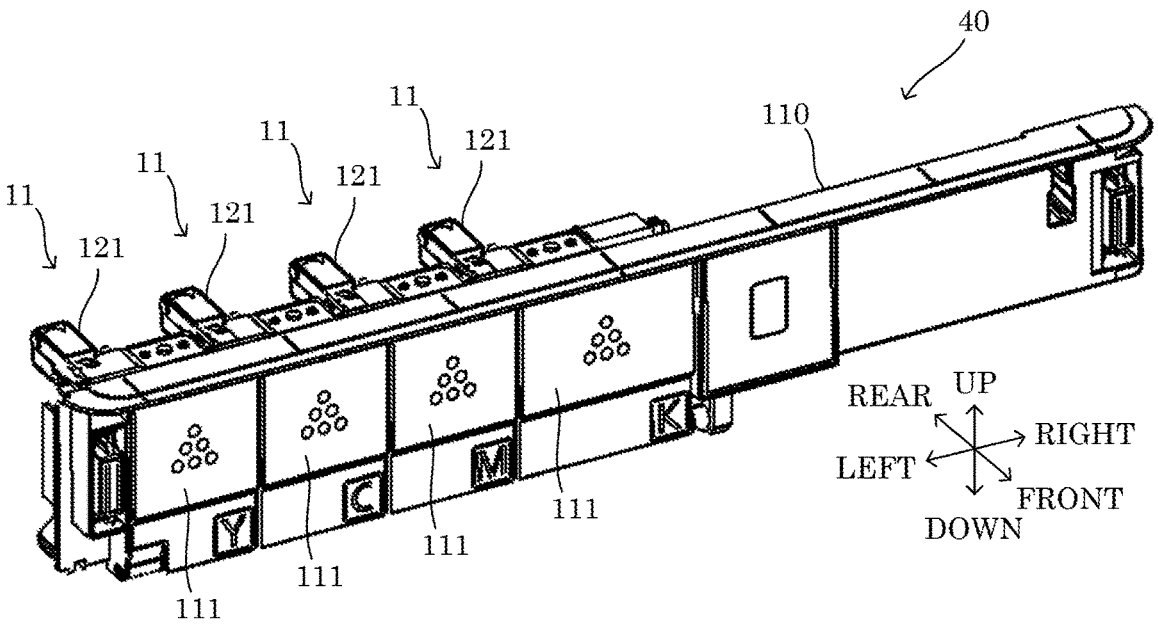
FIG. 5 is a diagram showing a configuration of a lock unit according to the first embodiment.
Figure 6:
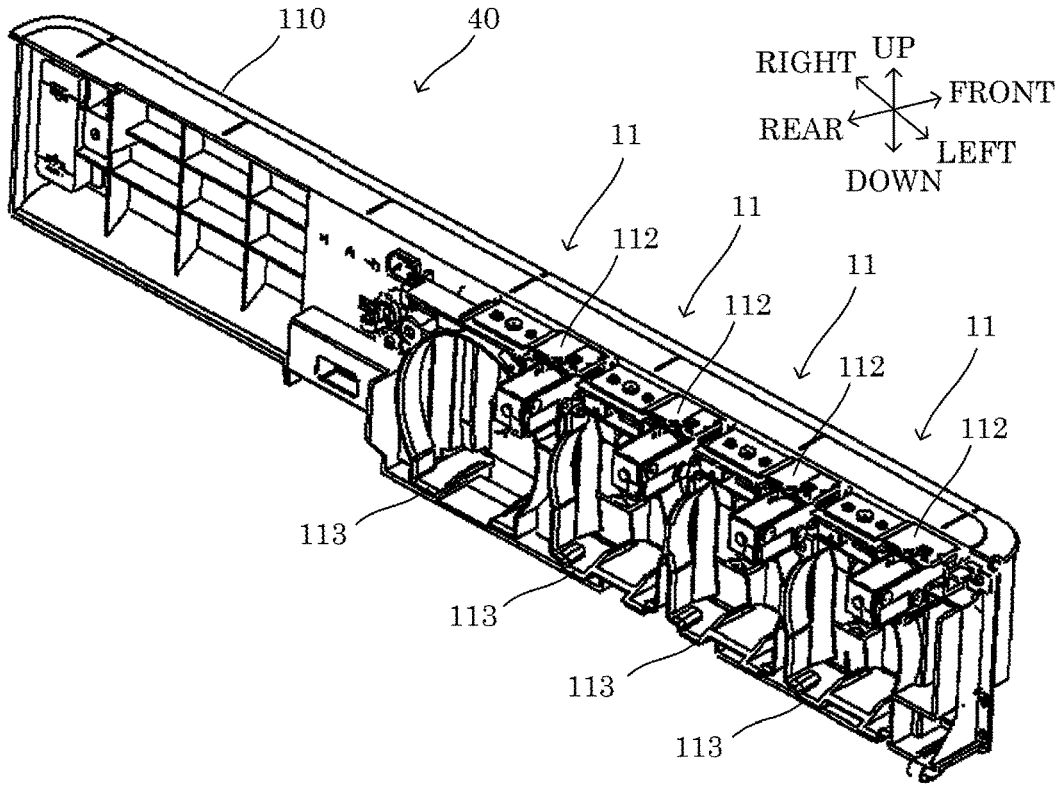
FIG. 6 is a diagram showing a configuration of the lock unit according to the first embodiment.

As shown in FIG. 5 and FIG. 6, the lock unit 40 includes four lock devices 11. Each of the lock devices 11 includes a lock cover 111, a lock mechanism 112, and an insertion portion 113 (an example of the opening portion).

A lower part of each lock cover 111 is pivotably supported by a pivot shaft that is provided in a housing 110 (an example of the frame member) of the lock unit 40, wherein the pivot shaft is parallel to the left-right direction. That is, as is the case with the front cover 10A of the container storage portion 10, it is possible to open each of the lock covers 111 by pivoting its upper part frontward.

The lock mechanisms 112 are configured to individually restrict opening of the lock covers 111. Each of the insertion portions 113 has an opening that is used to insert and remove a corresponding developer storage portion 101 to/from the container storage portion 10, and the opening is opened and closed by the lock cover 111. That is, in each lock device 11, when the lock cover 111 is locked by the lock mechanism 112, the insertion and removal of the corresponding developer storage portion 101 to/from the container storage portion 10 is restricted by the lock cover 111.

Meanwhile, in the image forming apparatus 100, when the user needs to open a lock cover 111 for a work-target developer storage portion 101, opening the lock cover 111 takes a lot of time and effort for the user. In addition, in a case where the lock unit 40 includes a plurality of lock covers 111 corresponding to a plurality of developer storage portions 101, the user needs to identify, from among the plurality of developer storage portions 101, a lock cover 111 for a work-target developer storage portion 101 and open it.

On the other hand, in the image forming apparatus 100, the time and effort of the user is reduced when he/she needs to open a lock cover 111 to attach or detach a corresponding developer storage portion 101.

Figure 14:
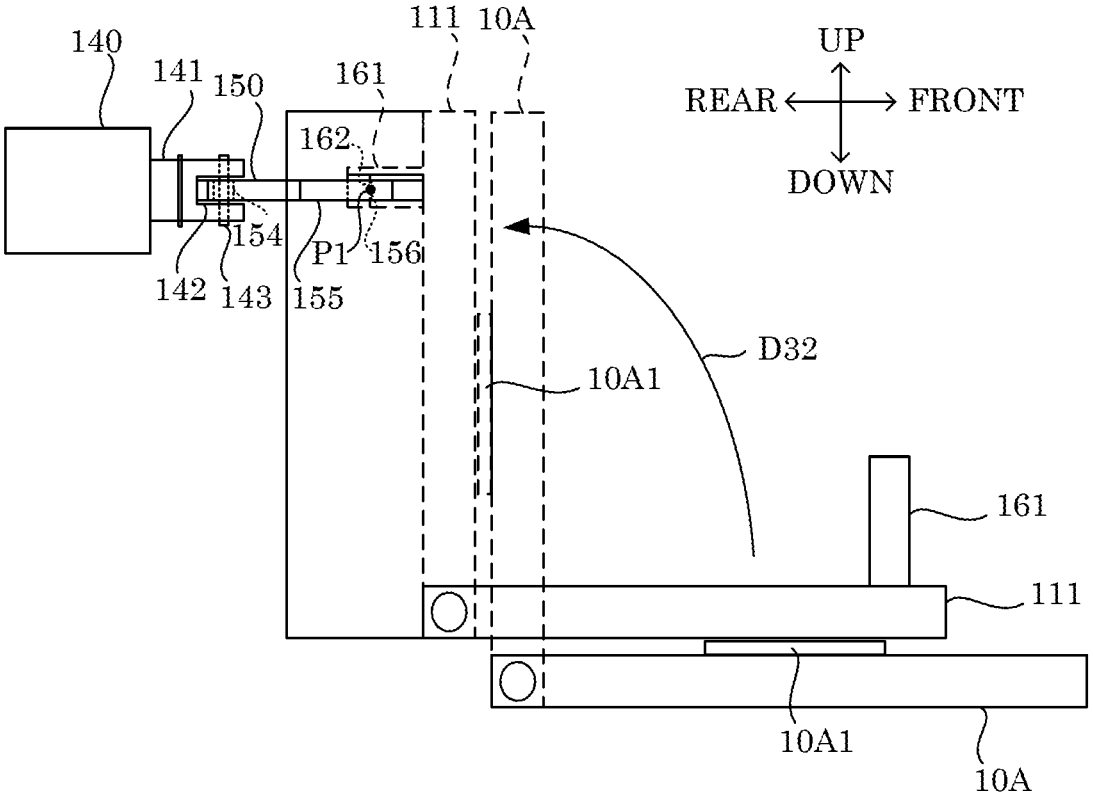
FIG. 14 is a diagram showing a configuration of a front cover according to the first embodiment.

FIG. 7 to FIG. 10 are main-part cross-sectional views of a lock device 11 viewed from above. In addition, FIG. 11 and FIG. 14 are schematic views of the lock device 11 viewed from left, wherein a fixing portion 110A and the like are omitted for the sake of convenience of drawing. It is noted that since the four lock devices 11 corresponding to the four developer storage portions 101 have the same configuration, only one lock device 11 among them is described in the following.

Figure 7:
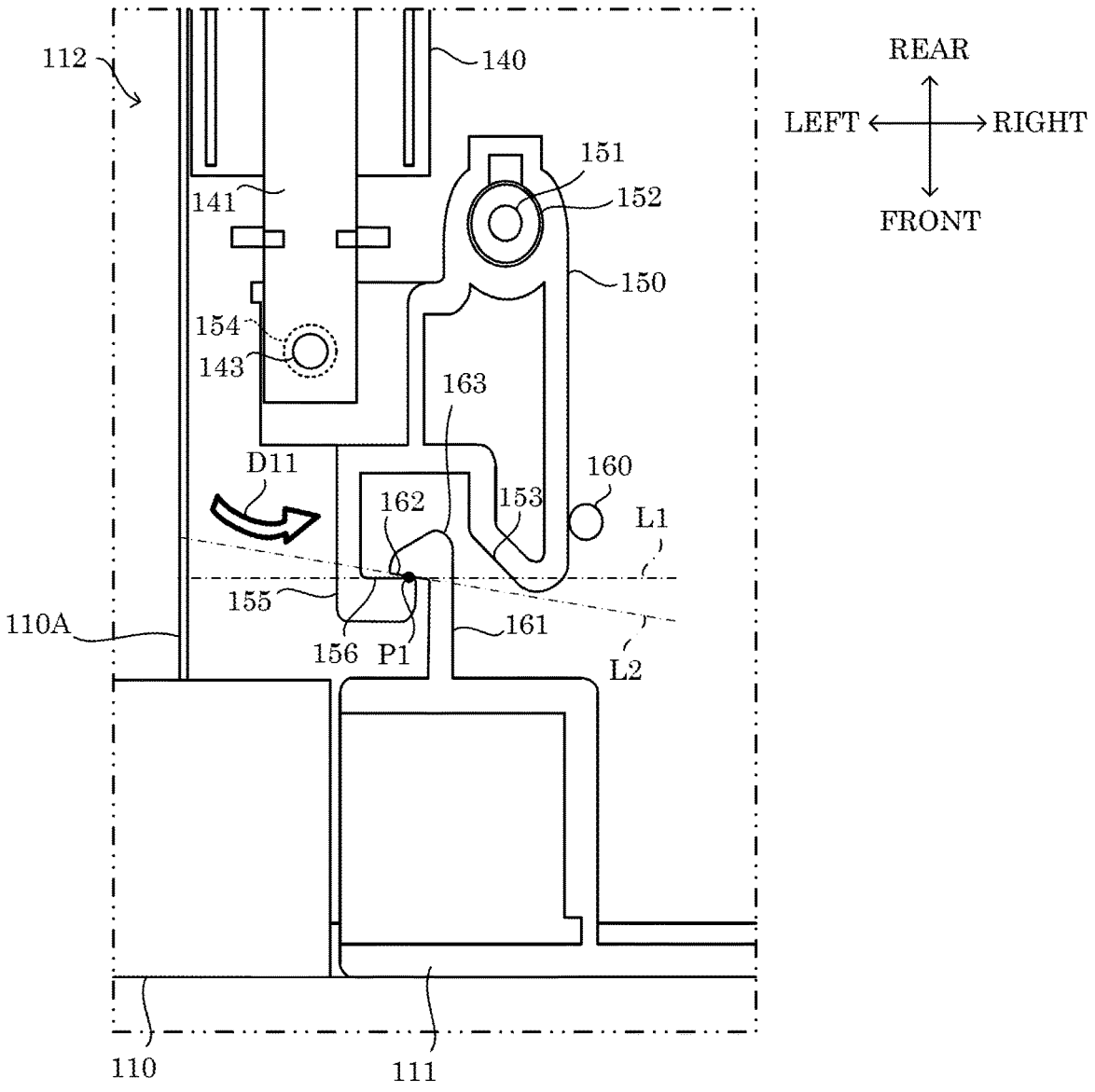
FIG. 7 is a diagram showing a configuration of a lock device according to the first embodiment.

As shown in FIG. 7, each lock mechanism 112 includes a drive source 140, a restricting portion 150, and a regulating portion 160. In each lock device 11, when the lock cover 111 is closed, opening of the lock cover 111 is restricted by the lock mechanism 112, and when the restricting portion 150 is driven by the drive source 140, the restriction of the lock cover 111 by the lock mechanism 112 is released and the lock cover 111 is opened (see FIG. 11).

Specifically, the lock cover 111 includes an engaging portion 161 that has a shape of a letter "L" and projects from an upper part of the lock cover 111 rearward. The engaging portion 161 has an abutting surface 162 that is formed such that an angle inside the letter-L part is larger than at least 90 degrees. In addition, the engaging portion 161 has an arc-shaped tip portion 163 at an outside of a corner of the letter-L part. It is noted that the restricting portion 150 and the lock cover 111 are molded from a resin material, for example.

On the other hand, the drive source 140 of the lock mechanism 112 is a solenoid that, in response to energization, attracts a movable portion 141 in an attraction direction D21 directed inward (an example of the predetermined direction). The drive source 140 is fixed to a fixing portion 110A that projects from the housing 110 of the lock device 11 rearward. In addition, as shown in FIG. 11 and the like, a cut 142 is formed in a tip of the movable portion 141. And in a state where the restricting portion 150 is inserted in the cut 142, a shaft portion 143 is attached to the movable portion 141 so as to pierce the movable portion 141 and the restricting portion 150. This allows the movable portion 141 to be coupled with the restricting portion 150.

When the lock cover 111 is closed, the restricting portion 150 restricts opening of the lock cover 111 by being engaged with the lock cover 111. The engagement of the restricting portion 150 with the lock cover 111 is released when the restricting portion 150 is driven by the drive source 140.

The restricting portion 150 is supported by the housing 110 of the lock device 11 so as to be pivotable around a pivot shaft 151, and is biased by a biasing portion 152 in a biasing direction D11 (an example of the second pivot direction). For example, the biasing portion 152 is an elastic member such as a coil spring that is inserted in the pivot shaft 151, one of opposite ends of the biasing portion 152 being engaged with the restricting portion 150, the other being engaged with the housing 110 of the lock device 11. It is noted that the biasing direction D11 is opposite to a pivot direction D22 (an example of the first pivot direction) of the restricting portion 150 when the restricting portion 150 is driven by the drive source 140, as described below.

The restricting portion 150 includes a pressing portion 153 (an example of the second pressing portion), an opening portion 154, and an engaging portion 155. The pressing portion 153, in conjunction with an operation of the drive source 140 of releasing the engagement of the restricting portion 150 with the lock cover 111, presses the engaging portion 161 of the lock cover 111 in an opening direction D31 of the lock cover 111, thereby causing the lock cover 111 to open automatically.

The opening portion 154 has an opening that is pierced by the shaft portion 143 of the movable portion 141. The diameter of the opening is larger than the outer diameter of the shaft portion 143. A linear movement of the movable portion 141 is converted to a rotational movement of the restricting portion 150 via the shaft portion 143 and the opening portion 154.

The engaging portion 155 is formed in a shape of a letter "L". The engaging portion 155 is engaged with the engaging portion 161 of the lock cover 111 when an abutting surface 156 at its tip abuts on the abutting surface 162 of the engaging portion 161 face-to-face, and thereby restricts opening of the lock cover 111.

Specifically, the engaging portion 155 and the engaging portion 161 constitute a snap-fit. That is, when the engaging portion 161 is inserted toward the engaging portion 155, one or both of them are once bent and then restored so that they are engaged with each other and restricted from separating from each other.

In the housing 110 of each lock device 11, when the restricting portion 150 is biased by the biasing portion 152 in the biasing direction D11, the regulating portion 160 regulates the pivoting of the restricting portion 150 at a predetermined position.

In each lock device 11, as shown in FIG. 7 to FIG. 10, the drive source 140 is controlled by the control portion 9 such that the lock of the lock cover 111 by the lock mechanism 112 is released and the lock cover 111 is opened. It is noted that the timing at which the control portion 9 causes the lock mechanism 112 to release the lock may be a predetermined arbitrary timing, as described above such as a timing when the front cover 10A is opened in a state where the remaining amount of developer in any of the developer storage portions 101 is equal to or smaller than the threshold.

Specifically, firstly, as shown in FIG. 7, in a case where the lock cover 111 is closed, the engaging portion 161 of the lock cover 111 is engaged with the engaging portion 155 of the restricting portion 150, and the lock cover 111 is in a locked state where opening of the lock cover 111 is restricted.

Figure 8:
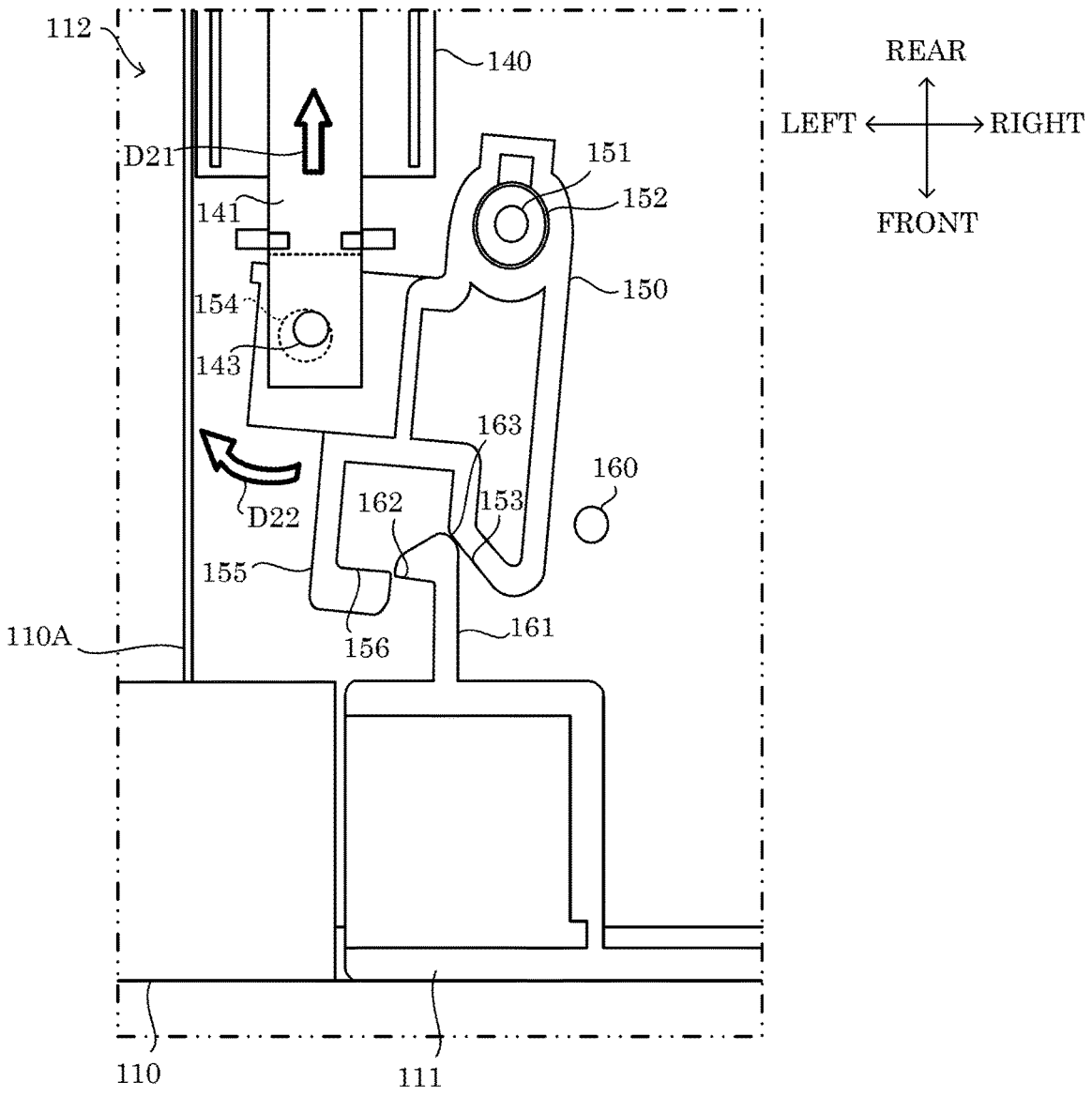
FIG. 8 is a diagram showing a state transfer of the lock device according to the first embodiment.

In this state, when the drive source 140 is driven by the control portion 9 and the movable portion 141 is attracted in an attraction direction D21, as shown in FIG. 8, the restricting portion 150, in conjunction with this, starts to pivot around the pivot shaft 151 in the pivot direction D22.

This releases the engagement of the engaging portion 155 with the engaging portion 161, allowing the engaging portion 161 to move frontward. In addition, as the restricting portion 150 pivots, at a predetermined timing, the pressing portion 153 of the restricting portion 150 comes into contact with the tip portion 163 of the engaging portion 161.

Figure 9:
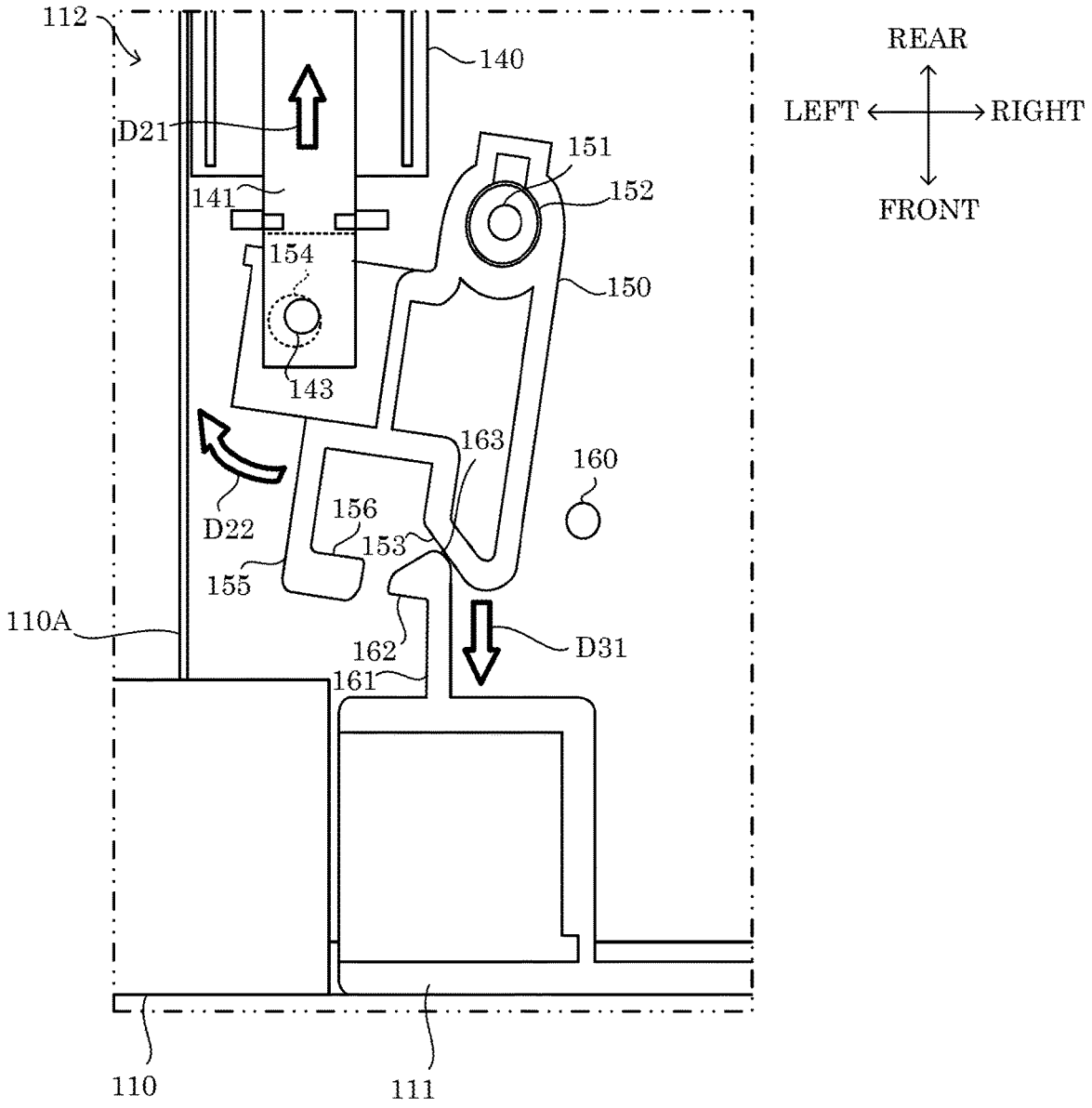
FIG. 9 is a diagram showing a state transfer of the lock device according to the first embodiment.

Subsequently, as shown in FIG. 9, when the movable portion 141 is further attracted in the attraction direction D21 and the restricting portion 150 further pivots in the pivot direction D22, the pressing portion 153 of the restricting portion 150 presses the tip portion 163 of the engaging portion 161 of the lock cover 111 frontward.

Here, the engaging portion 155, the engaging portion 161, the pressing portion 153, and the tip portion 163 are positioned and shaped such that a timing at which the engagement between the engaging portion 155 and the engaging portion 161 is released, is equal to or earlier than a timing at which the pressing portion 153 comes into contact with the tip portion 163. As a result, when the tip portion 163 of the engaging portion 161 is pressed by the pressing portion 153, the lock cover 111 is opened automatically by pivoting around the pivot shaft located at the lower part thereof (see FIG. 11).

Figure 10:
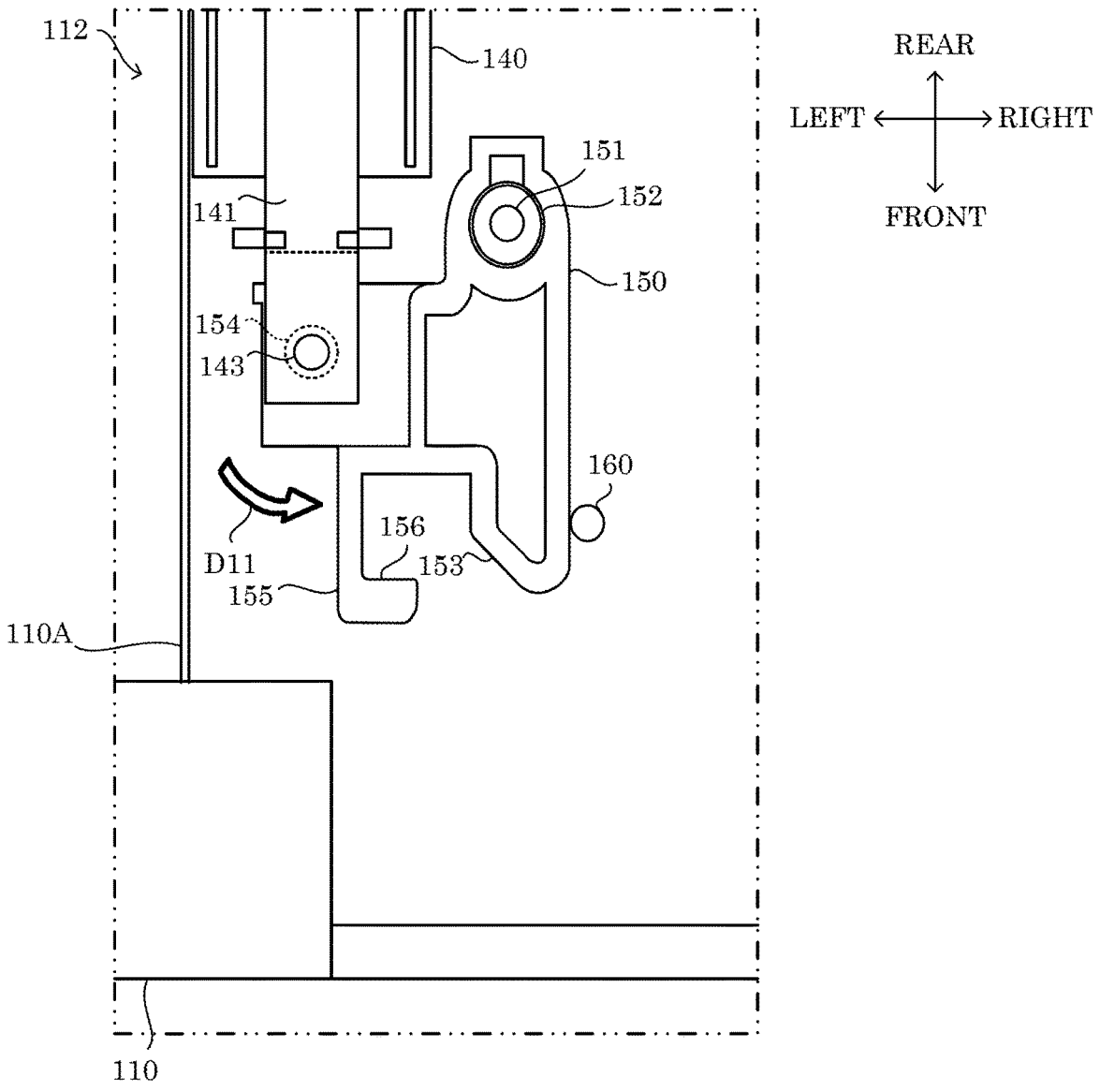
FIG. 10 is a diagram showing a state transfer of the lock device according to the first embodiment.
Figure 11:
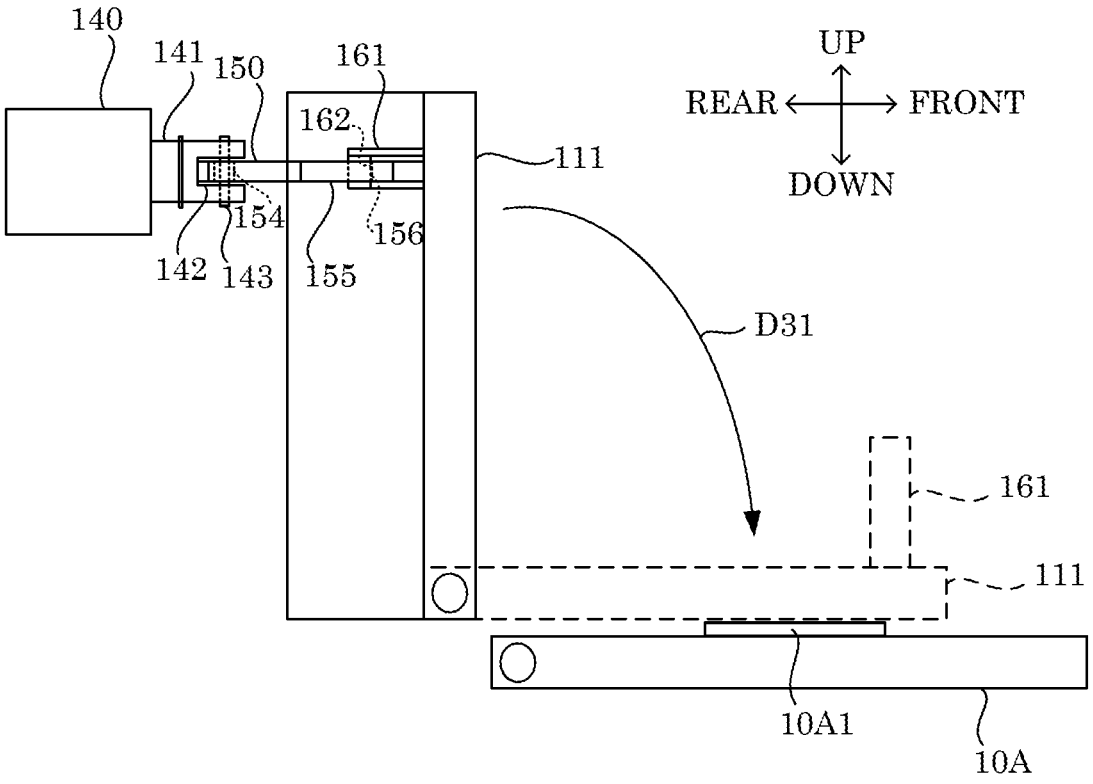
FIG. 11 is a diagram showing a state transfer of the lock device according to the first embodiment.

As shown in FIG. 10, when the lock cover 111 is opened, the restricting portion 150 is pivoted by a biasing force of the biasing portion 152 in the biasing direction D11 to a position where its pivoting is regulated by the regulating portion 160. With this configuration, when the lock cover 111 is closed next time, the engaging portion 161 of the lock cover 111 is engaged with the engaging portion 155 of the restricting portion 150, and opening of the lock cover 111 is restricted (see FIG. 7).

As described above, in each of the lock devices 11, when the drive source 140 is driven and thereby restricting portion 150 is pivoted, the lock of the lock cover 111 is released, and in conjunction with the releasing operation, the lock cover 111 is automatically opened. This makes it possible for the user to attach or detach a target developer storage portion 101 without performing a work of opening the lock cover 111. In addition, the user can clearly and easily determine that, among the four lock covers 111 corresponding to the four developer storage portions 101, a lock cover 111 that has been opened automatically is a lock cover 111 that corresponds to a work-target developer storage portion 101.

In addition, in the image forming apparatus 100, as described above, the front cover 10A is provided on the outer side of the lock covers 111 of the lock devices 11. Each of the front cover 10A and the lock covers 111 provided on the inner side of the front cover 10A, is pivotably supported by a pivot shaft located at the lower part thereof. As a result, both the front cover 10A and the lock covers 111 can be opened and closed by pivoting in the same direction. Here, in the image forming apparatus 100, as shown in FIG. 14, a plurality of ribs 10A1 (an example of the first pressing portions) are provided on an inner surface of the front cover 10A at positions that respectively face the lock covers 111, each rib 10A1 projecting from the inner surface of the front cover 10A. When the front cover 10A is closed in a state where the lock cover 111 is opened, the rib 10A1 comes into contact with the front surface of the lock cover 111, and presses the lock cover 111 in a closing direction D32. With this configuration, when the front cover 10A is closed in a state where the lock cover 111 is opened, the lock cover 111 is closed by the rib 10A1 of the front cover 10A. Accordingly, even when one or more lock covers 111 are opened, the user can close the one or more lock covers 111 only by closing the front cover 10A. This reduces the time and effort for attaching and detaching the developer storage portions 101.

It is noted that a pressed portion that projects from an outer surface of each lock cover 111 facing the rib 10A1 and is pressed by the rib 10A1 of the front cover 10A, may be provided on the outer surface of each lock cover 111. In addition, the first pressing portion of the present disclosure may be an inner surface of the front cover 10A.

Meanwhile, in the image forming apparatus 100, the user may try to wrench open a lock cover 111 of the developer storage portions 101 while it is in the locked state where opening of the lock cover 111 is restricted by the lock mechanism 112. On the other hand, the image forming apparatus 100 prevents the wrenching open of the lock cover 111 that would be opened and closed when the developer storage portion 101 is attached or detached, while it is in the locked state.

Figure 13:
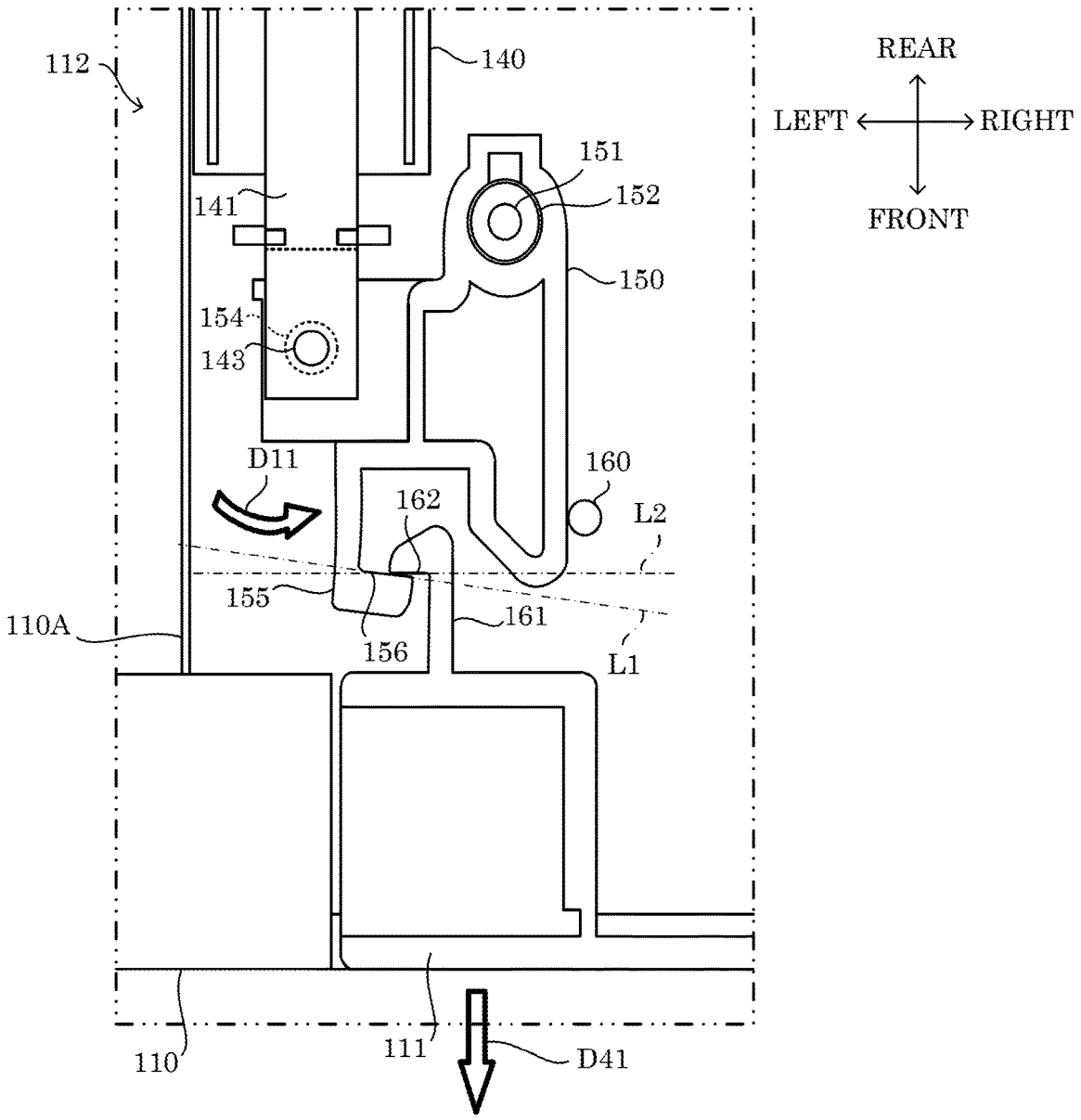
FIG. 13 is a diagram showing a comparative example of the lock device according to the first embodiment.

First, a configuration of a comparative example is as follows. That is, an extension line L2 of the abutting surface 162 and an extension line L1 of the abutting surface 156 are parallel to each other in a state where the lock cover 111 is closed, and the engaging portion 161 is engaged with the engaging portion 155. Specifically, both an angle inside the letter-L part of the abutting surface 162 of the engaging portion 161 and an angle inside the letter-L part of the abutting surface 156 of the engaging portion 155 are 90 degrees. In this case, as shown in FIG. 13, when the upper part of the lock cover 111 is pulled by the user in a wrench-open direction D41 that is directed frontward, and the engaging portion 161 is displaced frontward, the engaging portion 155 is bent leftward, and the abutting surface 156 of the engaging portion 155 is inclined. As a result, the tip of the engaging portion 161 is apt to move rightward along the abutting surface 156, and the engagement between the engaging portion 155 and the engaging portion 161 is apt to be released.

In contrast, according to the first embodiment of the present disclosure, as shown in FIG. 7, in each of the lock devices 11, the angle inside the letter-L part of the abutting surface 162 of the engaging portion 161 is larger than at least 90 degrees, while the angle inside the letter-L part of the abutting surface 156 of the engaging portion 155 of the restricting portion 150 is 90 degrees. That is, as shown in FIG. 7, the extension line L2 of the abutting surface 162 and the extension line L1 of the abutting surface 156 are not parallel to each other in the state where the lock cover 111 is closed and the engaging portion 161 is engaged with the engaging portion 155. It is noted that the angle inside the letter-L part of the abutting surface 156 may be smaller than 90 degrees.

Figure 12:
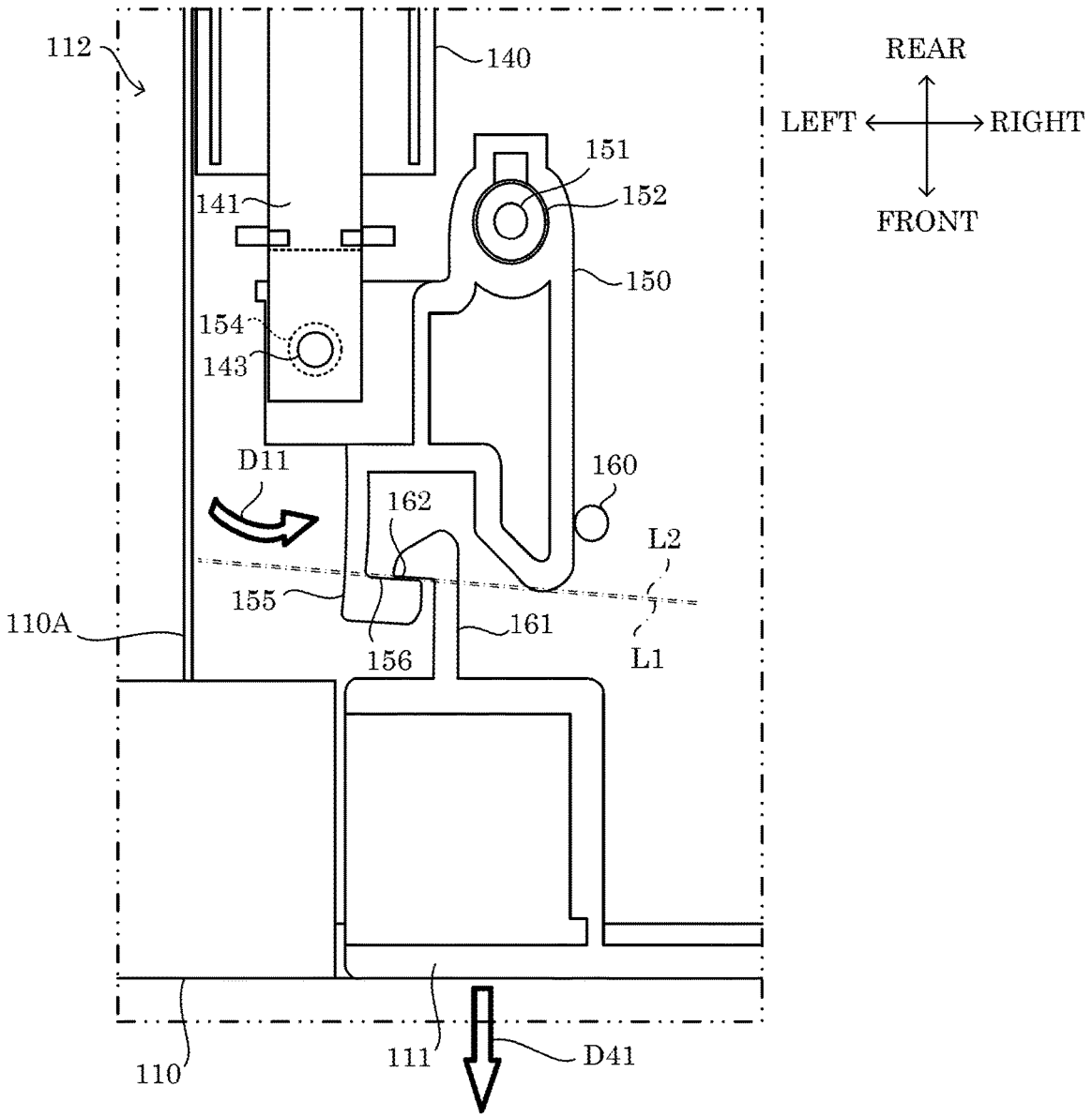
FIG. 12 is a diagram showing the lock device according to the first embodiment.

In each of the lock devices 11, as shown in FIG. 12, when the upper part of the lock cover 111 is pulled by the user in the wrench-open direction D41 directed frontward and the engaging portion 161 is displaced frontward, the engaging portion 155 is bent leftward, and the abutting surface 156 of the engaging portion 155 is inclined. As a result, when the upper part of the lock cover 111 is pulled by the user in the wrench-open direction D41 directed frontward, the extension line L1 of the abutting surface 156 and the extension line L2 of the abutting surface 162 become parallel to each other at some timing. With this configuration, in the lock device 11, when the engaging portion 155 is bent, the engaging portion 161 is pulled inward by the engaging portion 155 with a larger force. This makes it possible to restrict the lock cover 111 from being wrenched open.

Meanwhile, in a case where the front cover 10A is made of resin, even when the front cover 10A is closed, the lock cover 111 pressed by the front cover 10A may not reach a closing position P1 (see FIG. 7) due to a warpage that is generated during molding of the front cover 10A. This causes a malfunction that, even when the front cover 10A is closed, opening of the lock cover 111 is not restricted by the restricting portion 150.

Second Embodiment

Figure 15:
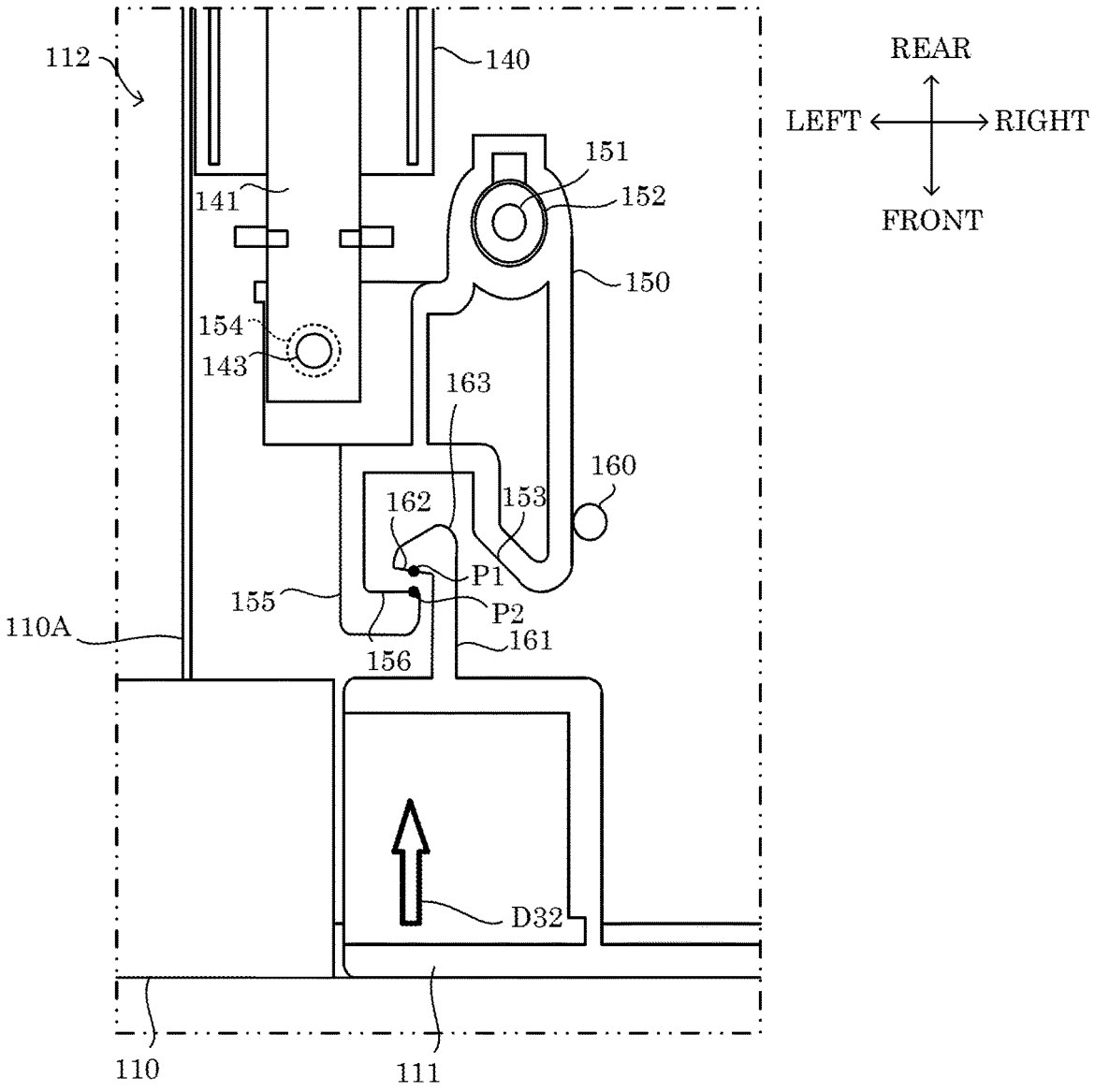
FIG. 15 is a diagram showing a configuration of a lock device according to a second embodiment.
Figure 16:
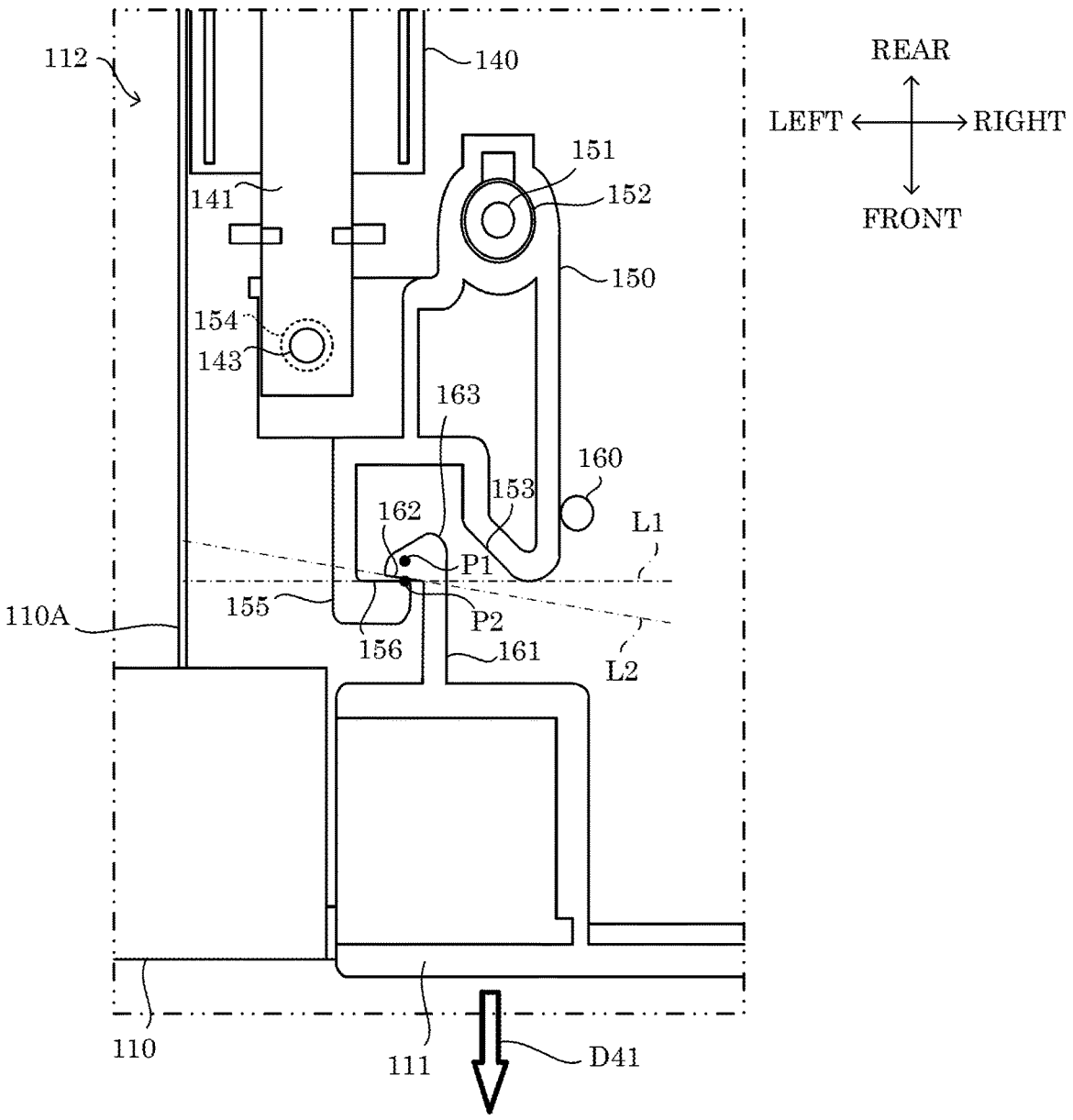
FIG. 16 is a diagram showing a configuration of the lock device according to the second embodiment.
Figure 17:
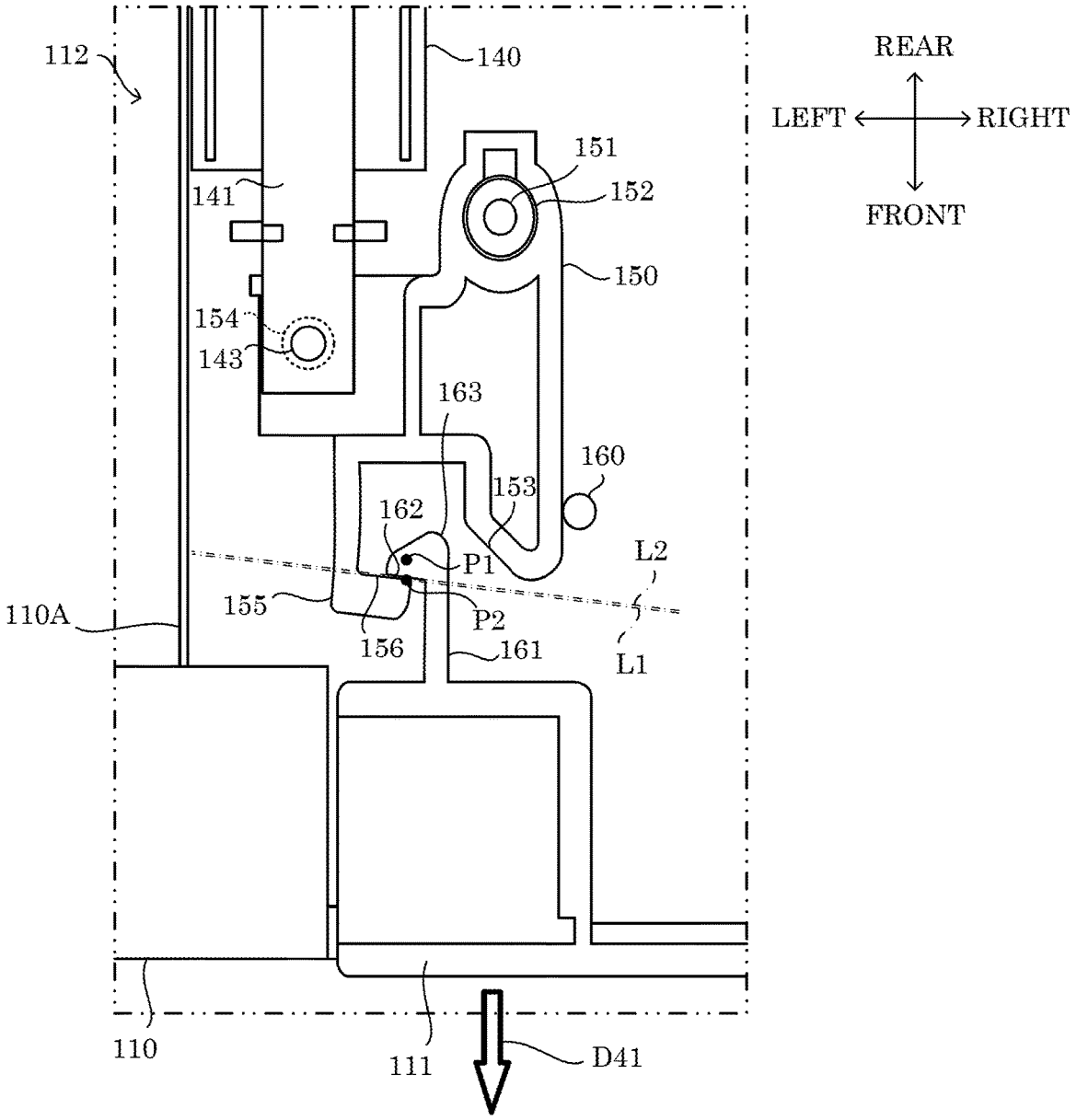
FIG. 17 is a diagram showing a configuration of the lock device according to the second embodiment.

In the following, a multifunction peripheral according to a second embodiment is described with reference to FIG. 15 to FIG. 17. FIG. 15 to FIG. 17 are main-part cross-sectional views of the lock device 11 according to the second embodiment, viewed from above. In the multifunction peripheral according to the second embodiment, the configuration of the restricting portion 150 is different from that in the first embodiment.

Specifically, when the lock cover 111 is closed, the restricting portion 150 is engaged with the lock cover 111 at a lock position P2 (see FIG. 15) that is located on the upstream side of a predetermined closing position P1 of the lock cover 111 in the closing direction D32, and restricts opening of the lock cover 111.

Here, the closing position P1 is a support position (see FIG. 14) at which the lock cover 111 is supported by the rib 10A1 in a case where the front cover 10A is not warped and the lock cover 111 has been closed accompanied with closing of the front cover 10A. In addition, the lock position P2 is a position separated from the closing position P1 by at least a distance that corresponds to an assumed maximum warpage amount of the front cover 10A.

With this configuration, opening of the lock cover 111 is restricted by the restricting portion 150 even in a case where the lock cover 111 pressed by the rib 10A1 by closing of the front cover 10A does not reach the closing position P1 due to a warpage of the front cover 10A. As a result, it is possible to prevent an occurrence of the malfunction that, even when the front cover 10A is closed, opening of the lock cover 111 that is closed together with the front cover 10A, is not restricted.

In addition, the restricting portions 150 are engaged with the lock covers 111 at lock positions P2 that are different for each of the lock covers 111. Specifically, each lock position P2 is determined based on the warpage amount at a position on the front cover 10A facing the lock cover 111. This enables the distance between the closing position P1 and the lock position P2 to be set to the minimum necessary, and rattling of each lock cover 111 is restricted.

For example, each lock cover 111 is opened to be more on the outer side than the vertical direction in a state where opening of the lock cover 111 is restricted by the restricting portion 150 (see FIG. 16). With this configuration, in the case where the restricting portion 150 is driven by the drive source 140 and the lock of the lock cover 111 is released, the lock cover 111 is easily opened automatically.

It is noted that each lock cover 111 may be parallel to the vertical direction in the state where the opening thereof is restricted by the restricting portion 150. In addition, when each lock cover 111 is parallel to the vertical direction in the state where the opening thereof is restricted by the restricting portion 150, the outer surface of each lock cover 111 may be flush with the outer surface of the housing 110 of the lock unit 40. This prevents the outer surface of the lock cover 111 that projects from the outer surface of the housing 110 of the lock unit 40, from interrupting the user in attachment and detachment of the developer storage portion 101.

In addition, in each of the lock devices 11 according to the second embodiment, as shown in FIG. 16, in the state where the lock cover 111 is disposed at the lock position P2, the abutting surface 162 is engaged with the abutting surface 156 in a state where they face each other. In addition, in each of the lock devices 11, in the state where the lock cover 111 is disposed at the lock position P2, the extension line L2 of the abutting surface 162 and the extension line L1 of the abutting surface 156 are not parallel to each other.

In addition, in each of the lock devices 11, when the upper part of the lock cover 111 is pulled by the user in the wrench-open direction D41 directed frontward and the engaging portion 161 is displaced from the lock position P2 frontward, the engaging portion 155 is bent leftward, and the abutting surface 156 of the engaging portion 155 is inclined, as shown in FIG. 17. As a result, when the upper part of the lock cover 111 is pulled by the user in the wrench-open direction D41 directed frontward, the extension line L1 of the abutting surface 156 and the extension line L2 of the abutting surface 162 become parallel to each other at some timing. With this configuration, as is the case with the lock devices 11 according to the first embodiment, when the engaging portion 155 is bent, the engaging portion 161 is pulled inward by the engaging portion 155 with a larger force. This makes it possible to restrict the lock cover 111 from being wrenched open.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an inner cover configured to be opened and closed for a developer storage portion storing developer to be attached or detached;

an outer cover made of resin provided on an outer side of the inner cover and configured to be opened and closed in a same direction as the inner cover;

a first pressing portion provided on the outer cover and configured to, when the outer cover is closed in a state where the inner cover is open, come into contact with the inner cover and press the inner cover in a closing direction;

a restricting portion configured to, when the inner cover is closed, be engaged with the inner cover at a lock position that is located on an upstream side of a predetermined closing position of the inner cover in the closing direction, and restrict opening of the inner cover;

a drive source configured to release an engagement between the restricting portion and the inner cover by driving the restricting portion;

a biasing portion configured to bias the restricting portion in a direction opposite to a driving direction of the drive source; and a second pressing portion provided in the restricting portion and configured to press the inner cover in an opening direction of the inner cover in conjunction with releasing of the engagement between the restricting portion and the inner cover by the drive source, wherein the restricting portion and the inner cover respectively include capital letter L-shaped engaging portions that include abutting surfaces that are engaged with each other while facing each other in a state where the inner cover is disposed at the lock position, an engaging portion of the inner cover projects from an upper part of the inner cover rearward, and an angle inside the engaging portion is larger than 90 degrees, whereas an angle inside an engaging portion of the restricting portion is 90 degrees, the abutting surfaces are not parallel to each other in the state where the inner cover is disposed at the lock position, and when the inner cover is displaced from the lock position in the opening direction while the drive source is not driving the restricting portion, either or both of the engaging portions are bent and the abutting surfaces become parallel to each other, the engaging portion of the inner cover has an arc-shaped tip portion at an outside of a corner of the engaging portion, and the second pressing portion is formed to project toward the inner cover, and while the drive source is driving the restricting portion, the second pressing portion comes into contact with the arc-shaped tip portion and presses the inner cover in the opening direction of the inner cover.

2. The image forming apparatus according to claim 1, wherein the closing position is a support position at which the inner cover is supported by the first pressing portion in a case where the outer cover is not warped and the inner cover has been closed accompanied with closing of the outer cover.

3. The image forming apparatus according to claim 1, wherein the first pressing portion is a projection portion that projects from an inner surface of the outer cover.

4. The image forming apparatus according to claim 1, wherein the inner cover is tilted to be more on an outer side than a vertical direction in a state where opening of the inner cover is restricted by the restricting portion, and when the inner cover is opened, an upper part thereof pivots outward.

5. The image forming apparatus according to claim 1, wherein the inner cover is parallel to a vertical direction in a state where opening of the inner cover is restricted by the restricting portion, and when the inner cover is opened, an upper part thereof pivots outward.

6. The image forming apparatus according to claim 5, wherein in a state where opening of the inner cover is restricted by the restricting portion, an outer surface of the inner cover is flush with an outer surface of a frame member that has an opening portion that is closed by the inner cover.

7. The image forming apparatus according to claim 1, wherein a plurality of the inner covers are provided in correspondence with a plurality of the developer storage portions, a plurality of the first pressing portions are provided on the outer cover at positions that respectively face the inner covers, and a plurality of the restricting portions are provided in correspondence with the plurality of the inner covers and are engaged with the inner covers at the lock positions that are different for each of the inner covers.

8. The image forming apparatus according to claim 1, wherein the drive source is a solenoid configured to, in response to energization, move a movable portion in a predetermined direction, the restricting portion is coupled with the movable portion and configured to pivot in a first pivot direction accompanied with a movement of the movable portion in the predetermined direction, and the biasing portion is a coil spring configured to bias the restricting portion in a second pivot direction that is opposite to the first pivot direction.

9. The image forming apparatus according to claim 1, further comprising:

a developer detecting portion configured to detect a remaining amount of developer in the developer storage portion; and an opening/closing detecting portion configured to detect opening and closing of the outer cover, wherein in a case where the developer detecting portion has detected that the remaining amount of developer in the developer storage portion is equal to or smaller than a predetermined threshold, and the opening/closing detecting portion has detected opening of the outer cover, the drive source is driven so as to release the engagement between the restricting portion and the inner cover.

* * * * *